US010667599B2

(12) United States Patent
Shtriker et al.

(10) Patent No.: US 10,667,599 B2
(45) Date of Patent: Jun. 2, 2020

(54) HARNESS

(71) Applicant: MAROM DOLPHIN LTD, Afula (IL)

(72) Inventors: Yehonatan Shtriker, Kiryat Tivon (IL); Nitay Glassman, Nahalal (IL); Moshe Kalman Cochavi, Jerusalem (IL)

(73) Assignee: MAROM DOLPHIN LTD., Afula (IL)

( * ) Notice: Subject to any disclaimer, the term of this patent is extended or adjusted under 35 U.S.C. 154(b) by 0 days.

(21) Appl. No.: 16/309,746

(22) PCT Filed: Jun. 14, 2017

(86) PCT No.: PCT/IL2017/050662

§ 371 (c)(1),
(2) Date: Dec. 13, 2018

(87) PCT Pub. No.: WO2017/216798

PCT Pub. Date: Dec. 21, 2017

(65) Prior Publication Data

US 2019/0133305 A1 May 9, 2019

Related U.S. Application Data

(60) Provisional application No. 62/349,698, filed on Jun. 14, 2016.

(51) Int. Cl.
*A45F 3/14* (2006.01)
*A45F 3/06* (2006.01)
(Continued)

(52) U.S. Cl.
CPC ..... *A45F 3/14* (2013.01); *A45F 3/04* (2013.01); *A45F 3/06* (2013.01);
(Continued)

(58) Field of Classification Search
CPC ..... A45F 3/14; A45F 3/06; A45F 3/08; A45F 2003/003; A45F 2003/045; A45F 2003/146
See application file for complete search history.

(56) References Cited

U.S. PATENT DOCUMENTS 5,634,576 A * 6/1997 Arbel ..... A45C 5/14 224/148.2
5,732,867 A * 3/1998 Perkins ..... A45F 3/08 224/271

(Continued)

FOREIGN PATENT DOCUMENTS

EP 0747095 A2 12/1996
WO 9815205 A1 4/1998

*Primary Examiner* — Corey N Skurdal
(74) *Attorney, Agent, or Firm* — William Dippert; Laurence Greenberg; Werner Stemer

(57) ABSTRACT

The harness system comprising: a harness comprising: a back supporting element; a first shoulder strap and a second shoulder strap; a waist strap; at least one upper back load fixing element, and at least one lower back load fixing element, wherein the at least one upper back load fixing element and the at least one lower back load fixing element are configured to fix the back load, a back load configured to be harnessed to the harness comprising: a body configured to contain gear to be carried; at least one upper anchoring element configured to correspondingly engage with the at least one upper back load fixing element, and at least one lower anchoring element configured to correspondingly engage with the at least one lower back load fixing element. A method for using the harness system and additional embodiments thereof are disclosed herein.

14 Claims, 4 Drawing Sheets

(51) Int. Cl.
*A45F 3/04* (2006.01)
*A45F 3/00* (2006.01)

(52) U.S. Cl.
CPC ... *A45F 2003/003* (2013.01); *A45F 2003/045* (2013.01); *A45F 2003/146* (2013.01)

(56) References Cited

U.S. PATENT DOCUMENTS

| | | | | |
|---|---|---|---|---|
| 5,743,447 | A | 4/1998 | McDermott | |
| 10,299,570 | B2 * | 5/2019 | Kim | A45F 3/047 |
| 2005/0184112 | A1 | 8/2005 | Copich | |
| 2006/0208024 | A1 | 9/2006 | Gleason, Jr. | |
| 2009/0071990 | A1 | 3/2009 | Jardine et al. | |
| 2009/0127299 | A1 | 5/2009 | Jamlang | |
| 2009/0173763 | A1 | 7/2009 | Bridgeman | |
| 2012/0018477 | A1 * | 1/2012 | Inouye | A45F 3/06 224/576 |

* cited by examiner

HARNESS

CROSS-REFERENCE TO RELATED APPLICATIONS

The present application is a National Phase filing under 35 U.S.C. § 371 of International Patent Application No. PCT/IL2017/050662, filed Jun. 14, 2017, which is based upon and claims the benefit of the priority date of U.S. Provisional Patent Application Ser. No. 62/349,698, filed Jun. 14, 2016, each of which is expressly incorporated herein by reference in its entirety.

FIELD

The present subject matter relates to load carrying devices. More particularly, the present subject matter relates to harnesses for loading back loads and front loads.

BACKGROUND

Military personnel, hikers and the like carry a variety of loads, for example a back load, a front load, a water container, and a bullet-proof shield. There are cases when there is a need to rapidly get rid of a back load, for example before engaging in a battle, or rapidly changing gear configuration by replacing one back load with another back load, this in addition to the ability to rapidly and simply loading a back load on a user's back.

SUMMARY

Unless otherwise defined, all technical and scientific terms used herein have the same meaning as commonly understood by one of ordinary skill in the art to which this subject matter belongs. Although methods and materials similar or equivalent to those described herein can be used in the practice or testing of the present subject matter, suitable methods and materials are described below. In case of conflict, the patent specification, including definitions, will control. In addition, the materials, methods, and examples are illustrative only and not intended to be limiting.

According to one aspect of the present subject matter, there is provided a harness system comprising:

a harness comprising:

a back supporting element;

a first shoulder strap and a second shoulder strap;

a waist strap;

at least one upper back load fixing element, and at least one lower back load fixing element, wherein the at least one upper back load fixing element and the at least one lower back load fixing element are configured to fix the back load, a back load configured to be harnessed to the harness comprising:

a body configured to contain gear to be carried;

at least one upper anchoring element configured to correspondingly engage with the at least one upper back load fixing element, and at least one lower anchoring element configured to correspondingly engage with the at least one lower back load fixing element.

According to one embodiment, the at least one upper back load fixing element and/or the at least one lower back load fixing element are lockable.

According to another embodiment, the at least one upper back load fixing element is attached to an upper part of the back supporting element, and the at least one lower back load fixing element is attached to the waist strap.

According to yet another embodiment, the at least one upper back load fixing element is attached to an upper part of the back supporting element, and the at least one lower back load fixing element is attached to a lower part of the back support element.

According to still another embodiment, a distance between the at least one upper back load fixing element and the at least one lower back load fixing element is fixed.

According to a further embodiment, a distance between the at least one upper back load fixing element and the at least one lower back load fixing element is changeable.

According to yet a further embodiment, the harness further comprises a release mechanism for releasing the back load from the back supporting element.

According to still a further embodiment, there is a fit in structure between the back supporting element and the back load, in a manner that allows proper loading of the back load on the back supporting element.

According to an additional embodiment, the back supporting element further comprises a sliding element positioned above the at least one upper back load fixing element, thus allowing sliding of the at least one upper anchoring element towards the at least one upper back load fixing element, when the back load is loaded on the back supporting element.

According to yet an additional embodiment, a bullet-proof plate holder is attached to the back supporting element.

According to still an additional embodiment, a water container is attached to the back supporting element.

According to one embodiment, the first shoulder strap and the second shoulder strap are configured to bear a front load.

According to another embodiment, the waist strap comprises a first buckle at the right side of the waist strap and a second buckle at the left side of the waist strap.

According to another aspect of the present subject matter, there is provided a method of fast harnessing and instantaneously releasing a back load on and off a user, the method comprising:

loading a harness on a torso of the user using shoulder straps and a waist strap that are provided to the harness, wherein said harness comprises at least one upper back load fixing element and at least one lower back load fixing element;

placing a back load having at least one upper anchoring element that corresponds to be engaged with the at least one upper back load fixing element and at least one lower anchoring element that corresponds to be engaged with the at least one lower back load fixing element;

instantaneously releasing the back load off the harness using a releasing mechanism.

BRIEF DESCRIPTION OF THE DRAWINGS

Embodiments are herein described, by way of example only, with reference to the accompanying drawings. With specific reference now to the drawings in detail, it is stressed that the particulars shown are by way of example and for purposes of illustrative discussion of the preferred embodiments, and are presented in the cause of providing what is believed to be the most useful and readily understood description of the principles and conceptual aspects of the embodiments. In this regard, no attempt is made to show structural details in more detail than is necessary for a fundamental understanding, the description taken with the drawings making apparent to those skilled in the art how several forms may be embodied in practice.

In the drawings.

DESCRIPTION OF THE PREFERRED EMBODIMENTS

Figure 1:
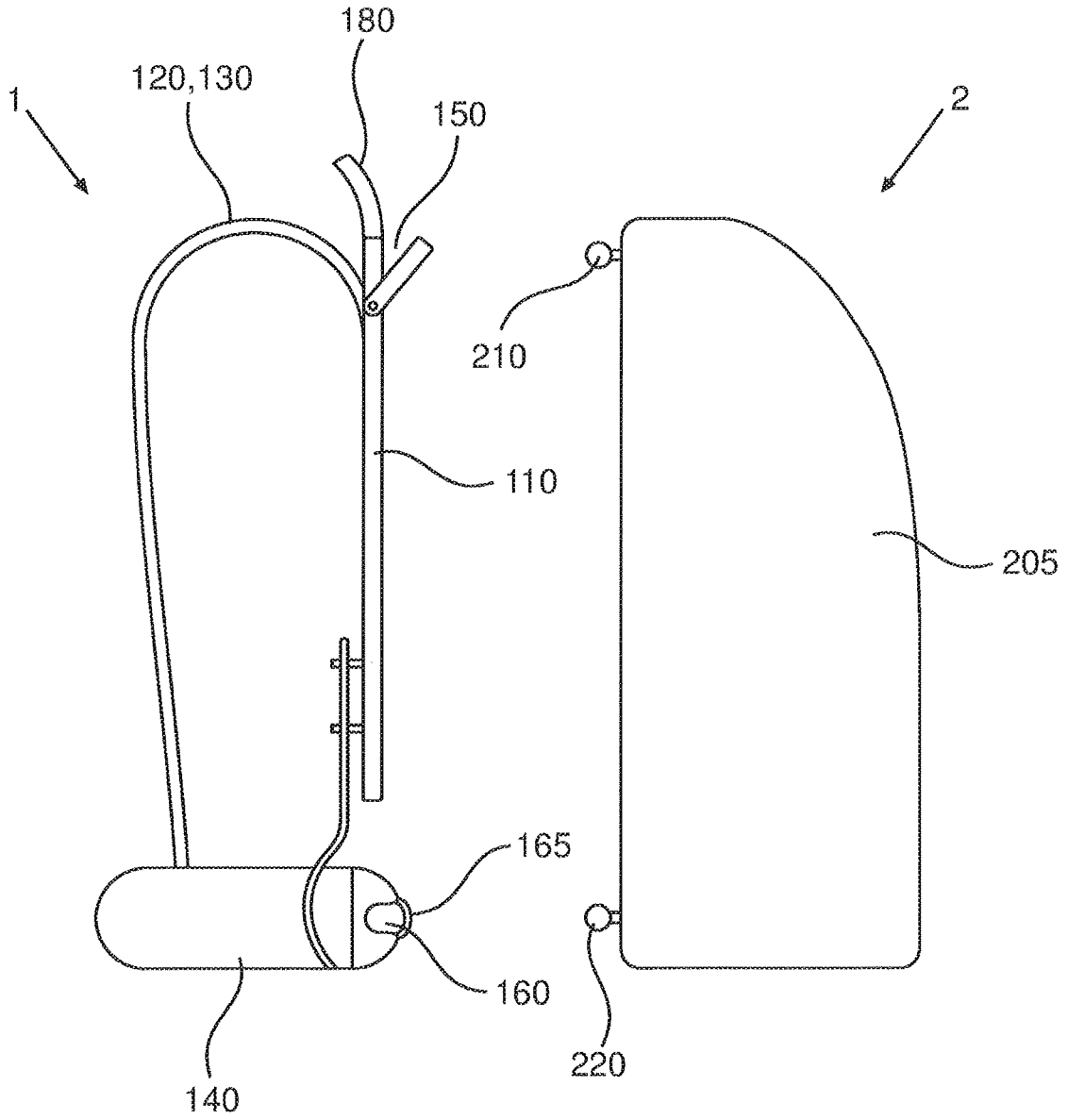
FIG. 1 schematically illustrates, according to a first exemplary embodiment, a side view of a harness and a back load.

Before explaining at least one embodiment in detail, it is to be understood that the subject matter is not limited in its application to the details of construction and the arrangement of the components set forth in the following description or illustrated in the drawings. The subject matter is capable of other embodiments or of being practiced or carried out in various ways. Also, it is to be understood that the phraseology and terminology employed herein is for the purpose of description and should not be regarded as limiting. In discussion of the various figures described herein below, like numbers refer to like parts. The drawings are generally not to scale.

For clarity, non-essential elements were omitted from some of the drawings.

One aim of the present subject matter is to provide a harness for harnessing at least one front load and at least one back load on a user.

Another aim of the present subject matter is to provide a harness that enables rapid and simple loading and unloading of a back load.

According to one aspect of the present subject matter there is provided a harness system comprising:

a harness comprising:

a back supporting element;

a first shoulder strap and a second shoulder strap;

a waist strap;

at least one upper back load fixing element, and at least one lower back load fixing element, wherein the at least one upper back load fixing element and the at least one lower back load fixing element are configured to fix the back load, a back load configured to be harnessed to the harness comprising:

a body configured to contain gear to be carried;

at least one upper anchoring element configured to correspondingly engage with the at least one upper back load fixing element, and at least one lower anchoring element configured to correspondingly engage with the at least one lower back load fixing element.

The present subject matter provides a harness for harnessing at least one front load and at least one back load on a user.

The present subject matter further provides a harness that enables rapid and simple loading and unloading of a back load.

FIG. 1 schematically illustrates, according to a first exemplary embodiment, a side view of a harness 1 and a back load 2 that together form the harness system.

Figure 2:
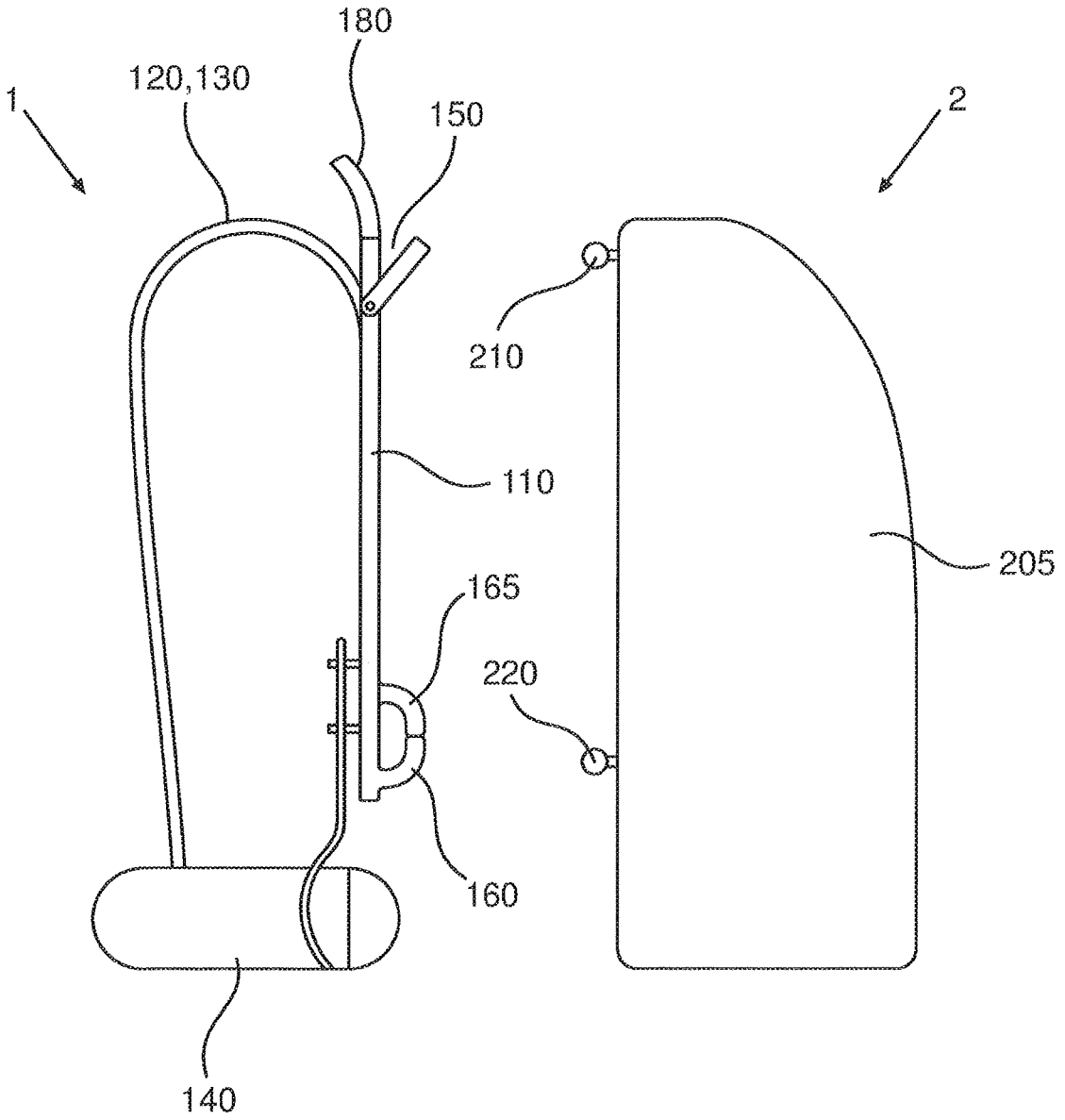
FIG. 2 schematically illustrates, according to a second exemplary embodiment, a side view of a harness and a back load.

FIG. 2 schematically illustrates, according to a second exemplary embodiment, a side view of a harness 1 and a back load 2.

According to one embodiment, the harness 1 comprises: a back supporting element 110 configured to support the back load 2; a first shoulder strap 120 and a second shoulder strap 130 configured to strap the harness 1 on the shoulders of the user, a waist strap 140 configured to strap the harness 1 around the waist of a user; at least one upper back load fixing element 150, and at least one lower back load fixing element 160. The at least one upper back load fixing element 150 and the at least one lower back load fixing element 160 are configured to fix in place the back load 2. Accordingly, the back load 2 comprises a body 205 configured to contain gear to be carried by a user, at least one upper anchoring element 210 configured to engage with the corresponding at least one upper back load fixing element 150, and at least one lower anchoring element 220 configured to engage with the corresponding at least one lower back load fixing element 160.

According to one embodiment, the at least one upper load fixing element 150 and the at least one lower back load fixing element 160 have a hook-like structure, and the corresponding at least one upper anchoring element 210 and at least one lower anchoring element 220 have a hinge-like structure. Thus, the at least one upper hinge-like anchoring element 210 and the at least one lower hinge-like anchoring element 220 are configured to be accommodated in the corresponding at least one upper hook-like back load fixing element 150 and at least one lower hook-like back load fixing element 160. According to a preferred embodiment, the back supporting element 110 comprises two upper hook-like load fixing elements 150—one on each side of the back supporting element 110, and two lower hook-like load fixing elements 160—one on each side of the back supporting element 110. According to another preferred embodiment, the back load 2 comprises an upper hinge-like anchoring element 210, configured to be accommodated in the two upper hook-like load fixing elements 150; and a lower hinge-like anchoring element 220, configured to be accommodated in the two lower hook-like load fixing elements 160. According to yet another embodiment, any mechanism known in art for releasably attaching the at least one upper anchoring element 210 to the at least one upper back load fixing element 150, and any mechanism known in the art for releasably attaching the at least one lower anchoring element 220 to the at least one lower back load fixing element 160, are under the scope of the present subject matter.

According to one embodiment, the at least one upper back load fixing element 150 and/or the at least one lower back load fixing element 160 are lockable. Any locking mechanism known in the art that allows locking of the at least one upper back load fixing element 150 and/or the at least one lower back load fixing element 160 is under the scope of the present subject matter, for example but not limited to, a handle that allows locking and releasing of the at least one upper back load fixing element 150 and/or the at least one lower back load fixing element 160. Thus, the at least one upper back load fixing element 150 and/or the at least one lower back load fixing element 160 may be in either one of two states—an open state and a locked state. The open state allows the release of the at least one upper anchoring element 210 from the at least one upper back load fixing element 150, and/or the release of the at least one lower anchoring element 220 from the at least one lower back load fixing element 160, thus allowing the release the back load 2 from the back supporting element 110 of the harness 1. On the other hand, the closed state locks the at least one upper anchoring element 210 with the at least one upper back load fixing element 150, and/or the at least one lower anchoring element 220 with the at least one lower back load fixing element 160, thus locking the back load 2 with the back supporting element 110 of the harness 1.

According to one embodiment, the at least one upper back load fixing element 150 and the at least one lower back load fixing element 160 of the back supporting element 110, and the at least one upper anchoring element 210 and the at least one lower anchoring element 220 of the back load 2 allow easy and rapid loading and fixing of the back load 2 to the back supporting element 110. According to another embodiment, the at least one upper back load fixing element 150 and the at least one lower back load fixing element 160 of the back supporting element 110, and the at least one upper anchoring element 210 and the at least one lower anchoring element 220 of the back load 2 allow easy, convenient and rapid releasing of the back load 2 from the back supporting element 110. Furthermore, after the back load 2 is released from the back supporting element 110, it is easy to rapidly reload the back load 2 on the back supporting element 110, without needing an aid of another user or usage of tools or machinery.

According to one embodiment, illustrated in FIG. 1, the at least one upper back load fixing element 150 is attached to an upper part of the back supporting element 110, and the at least one lower back load fixing element 160 is attached to the waist strap 140.

According to another embodiment, the at least one upper back load fixing element 150 is permanently attached to the upper part of the back supporting element 110; and the at least one lower back load fixing element 160 is permanently attached to the waist strap 140.

According to yet another embodiment, the at least one upper back load fixing element 150 is attached to the upper part of the back supporting element 110 in a manner that allows adjusting the height of the at least one upper back load fixing element 150 on the upper part of the back supporting element 110; and the at least one lower back load fixing element 160 is permanently attached to the waist strap 140.

According to still another embodiment, the at least one upper back load fixing element 150 is permanently attached to the upper part of the back support element 110; and the at least one lower back load fixing element 160 is attached to the waist strap 140 in a manner that allows adjusting the height of the at least one lower back load fixing element 160 on the waist strap 140.

According to a further embodiment, the at least one upper back load fixing element 150 is attached to the upper part of the back supporting element 110 in a manner that allows adjusting the height of the at least one upper back load fixing element 150 on the upper part of the back supporting element 110; and the at least one lower back load fixing element 160 is attached to the waist strap 140 in a manner that allows adjusting the height of the at least one lower back load fixing element 160 on the waist strap 140.

According to one embodiment, illustrated in FIG. 2, the at least one upper back load fixing element 150 is attached to an upper part of the back supporting element 110, and the at least one lower back load fixing element 160 is attached to a lower part of the back support element 110.

According to another embodiment, the at least one upper back load fixing element 150 is permanently attached to the upper part of the back supporting element 110; and the at least one lower back load fixing element 160 is permanently attached to the lower part of the back support element 110.

According to yet another embodiment, the at least one upper back load fixing element 150 is attached to the upper part of the back supporting element 110 in a manner that allows adjusting the height of the at least one upper back load fixing element 150 on the upper part of the back supporting element 110; and the at least one lower back load fixing element 160 is permanently attached to the lower part of the back support element 110.

According to still another embodiment, the at least one upper back load fixing element 150 is permanently attached to an upper part of the back support element 110; and the at least one lower back load fixing element 160 is attached to the lower part of the back support element 110 in a manner that allows adjusting the height of the at least one lower back load fixing element 160 on the lower part of the back support element 110.

According to a further embodiment, the at least one upper back load fixing element 150 is attached to an upper part of the back supporting element 110 in a manner that allows adjusting the height of the at least one upper back load fixing element 150 on the upper part of the back supporting element 110; and the at least one lower back load fixing element 160 is attached to the lower part of the back support element 110 in a manner that allows adjusting the height of the at least one lower back load fixing element 160 on the lower part of the back support element 110.

According to one embodiment, the waist strap 140 is permanently attached to the back supporting element 110. According to another embodiment, the waist strap 140 is attached to the back supporting element 110 in a manner that allows adjusting the height of the waist strap 140 on the back supporting element 110.

Any mechanism known in the art that allows adjusting the height of the at least one upper back load fixing element 150, the height of the at least one lower back load fixing element 160, and the height of the waist strap 140, is under the scope of the present subject matter. Examples include, but not limited to, at least one rail-like element attached to the back supporting element 110 on which the at least one upper back load fixing element 150, the at least one lower back load fixing element 160, and the waist strap 140 may slide up and down, and fixed to the rail-like element at a desired height.

A person skilled in the art may recognize that adjustment of the height of the at least one upper back load fixing element 150, and/or the at least one lower back load fixing element 160, and/or the waist strap 140 in embodiments where the at least one lower back load fixing element 160 is attached to the waist strap 140—actually changes the distance between the at least one upper back load fixing element 150 and the at least one lower back load fixing element 160.

According to one embodiment, the at least one upper anchoring element 210 may be permanently attached to the back load 2, or attached to the back load 2 in a manner that allows adjusting the height of the at least one upper anchoring element 210. Similarly, the at least one lower anchoring element 220 may be permanently attached to the back load 2, or attached to the back load 2 in a manner that allows adjusting the height of the at least one lower anchoring element 220.

A person skilled in the art may recognize that adjustment of the height of the at least one upper anchoring element 210 and/or the at least one lower anchoring element 220—actually changes the distance between the at least one upper anchoring element 210 and the at least one lower anchoring element 220.

According to some of the aforementioned embodiments, changing the distance between the at least one upper back load fixing element 150 and the at least one lower back load fixing element 160, as well as changing the distance between the at least one upper anchoring element 210 and the at least one lower anchoring element 220—allows fitting of the back load 2 to users in different sizes, while providing a one-size back load 2.

It should be noted though that the aforementioned mechanisms for adjusting the distance between the at least one upper back load fixing element 150 and the at least one lower back load fixing element 160, as well as the aforementioned mechanisms for adjusting the distance between the at least one upper anchoring element 210 and the at least one lower anchoring element 220—are configured to allow easy and rapid adjustment of the said distances without the aid of another user, and without tooling, thus improving the usage of the harness 1 and back load 2 of the present subject matter.

A preferred embodiment, illustrated in FIG. 2, is when the at least one upper back load fixing element 150 and the at least one lower back load fixing element 160 are permanently attached to the back support element 110, thus the distance between them is fixed; and the at least one upper anchoring element 210 and the at least one lower anchoring element 220 are permanently attached to the back load 2, thus the distance between them is fixed. An advantage of this preferred embodiment is that in order to fit the harness 1 and the back load 2 to the height of a user, only the height of the waist strap 140 relative to the back supporting element 110 has to be adjusted, thus facilitating the fitting process of the harness 1 and back load 2 to the height of the user. Another advantage is that this preferred embodiment facilitates that production process of the harness 1 and the back load 2, since all units of the harness 1 and back load 2 are uniform in terms of the distance between the at least one upper back load fixing element 150 and the at least one lower back load fixing element 160 on the back support element 110 of the harness 1; and also uniform in terms of the distance between the at least one upper anchoring element 210 and the at least one lower anchoring element 220 on the back load 2.

There is provided a release mechanism for releasing the back load 2 from the back supporting element 110. The release mechanism allows disengagement of the at least one upper anchoring element 210 from the at least one upper back load fixing element 150, and/or disengagement of the at least one lower anchoring element 220 from the at least one lower back load fixing element 160. Any release mechanism that is configured to disengage the at least one upper anchoring element 210 from the at least one upper back load fixing element 150, and/or disengage the at least one lower anchoring element 220 from the at least one lower back load fixing element 160, is under the scope of the present subject matter. Examples of such a mechanism include, but not limited to, a pushbutton, a string, a pull handle, and the like, that is operably connected to the at least one upper back load fixing element 150 and/or the at least one lower back load fixing element 160. According to one embodiment, there is a release mechanism for the at least one upper back load fixing element 150, and there is a release mechanism for the at least one lower back load fixing element 160. Thus, each one of them is disengaged independently. According to a preferred embodiment, there is one release mechanism for the at least one upper back load fixing element 150 and the at least one lower back load fixing element 160. This preferred embodiment allows simultaneous disengagement of the at least one upper back load fixing element 150 and the at least one lower back load fixing element 160, thus rendering the release of the back load 2 from the back supporting element 110 a rapid and simple process.

Figure 3:
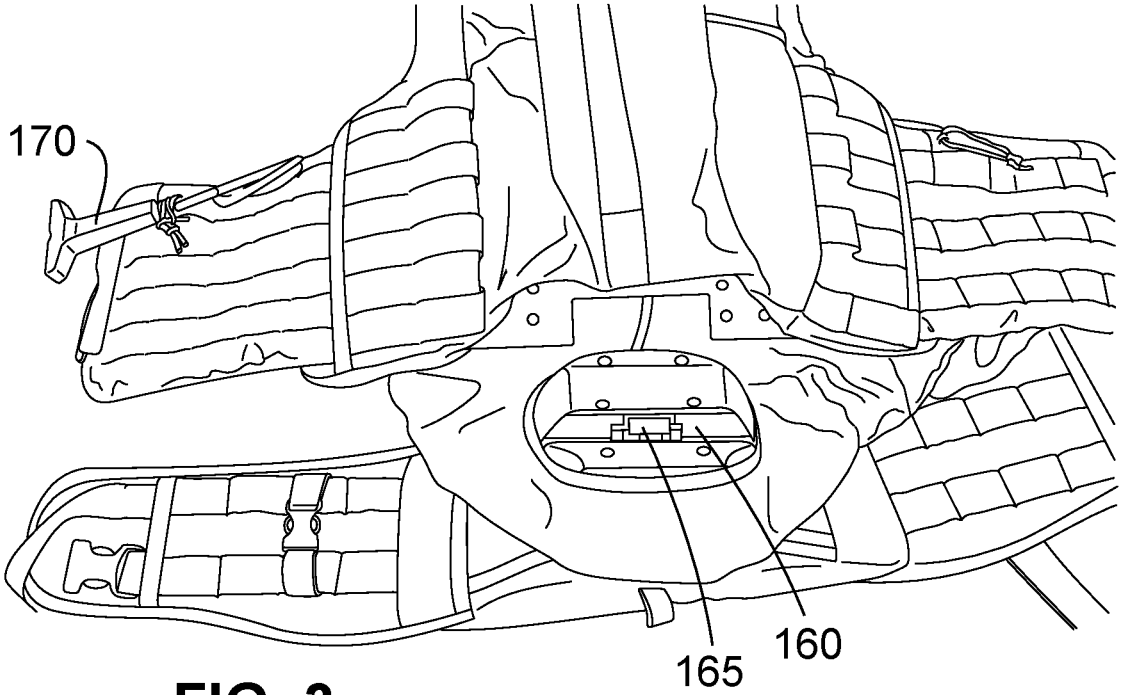
FIG. 3 schematically illustrates, according to an exemplary embodiment, a back view of a harness comprising a release mechanism for releasing the back load from the back supporting element.

FIG. 3 schematically illustrates, according to an exemplary embodiment, a back view of a harness 1 comprising a release mechanism for releasing the back load 2 from the back supporting element 110. The exemplary release mechanism comprises a pull handle 170 operably connected to a locking element 165 (also illustrated in FIGS. 1 and 2) in a lower back load fixing element 160. The locking element 165 may be in a default locked state. When the pull handle 170 is pulled by a user, the locking element switches to an open state, thus allowing release of a lower anchoring element 220 of a back load 2 engaged with the lower back load fixing element 160.

According to one embodiment, there is a fit in structure between the back supporting element 110 and the back load 2, in a manner that allows proper loading of the back load 2 on the back supporting element 110.

Figure 4A:
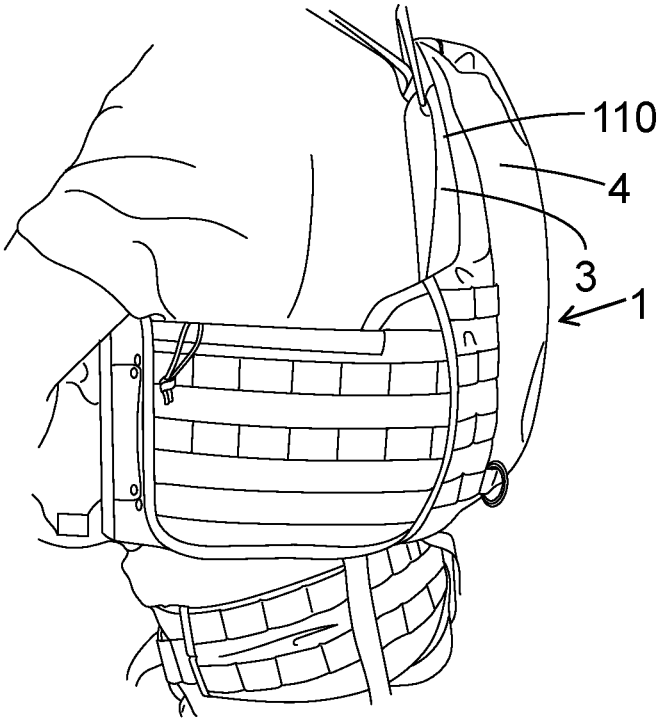
FIG. 4A schematically illustrates, according to an exemplary embodiment, a side view of a harness, and FIG. 4B schematically illustrates, according to an exemplary embodiment, a front view of a back load—showing a fit in structure between the back supporting element of the harness and back load.
Figure 4B:
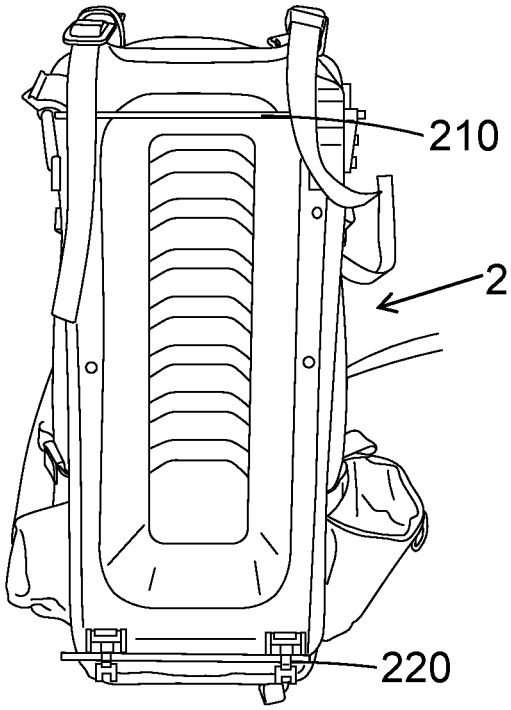

FIG. 4A schematically illustrates, according to an exemplary embodiment, a side view of a harness 1, and FIG. 4B schematically illustrates, according to an exemplary embodiment, a front view of a back load 2—showing a fit in structure between the back supporting element 110 of the harness 1 and back load 2. Additional components, for example a bullet-proof plate holder 3, or a water container 4, that are described in more detail hereinafter, may be attached to the back supporting element 110 of the harness 1. According to the embodiment illustrated in FIG. 4A, the back supporting element 110 and the additional components attached to it, have a convex structure, and the back load 2, illustrated in FIG. 4B, has a corresponding concave structure, thus allowing proper fit of the back load 2 with the back supporting element 110. Similarly, as illustrated in FIGS. 1 and 2, the back supporting element 110 may have a straight structure, and the back load 2 may have also a corresponding straight structure.

Turning now to FIGS. 1 and 2, according to one embodiment, the back supporting element 110 further comprises a sliding element 180 positioned above the at least one upper back load fixing element 150, thus allowing sliding of the at least one upper anchoring element 210 towards the at least one upper back load fixing element 150, when the back load 2 is loaded on the back supporting element 110.

Turning now to FIG. 4A, according to one embodiment, a bullet-proof plate holder 3 is attached to the back supporting element 110. The bullet-proof plate holder 3 is configured to temporarily accommodate a bullet-proof plate, for example a ceramic bullet-proof plate. According to this embodiment, a user may insert a bullet-proof plate into the bullet-proof plate holder 3, or not. Furthermore, the back pack 2 is configured to the attached to the back supporting element 110 over the bullet-proof plate holder 3 that is attached to the back supporting element 110. It should be noted that according to some embodiments a bullet-proof plate may be attached directly to the back supporting element 110, without the need of a bullet-proof plate holder 3.

Turning now to FIG. 4A, according to one embodiment, a water container 4 is attached to the back supporting element 110. The water container 4 is configured to store water for usage by a user. According to another embodiment, the water container 4 is attached to an outer surface of a bullet-proof plate holder 3 that is attached to the back supporting element 110. Furthermore, the back pack 2 is configured to be attached to the back supporting element 110 over the water container 4 that is attached to the back support element 110, or to the outer surface of the bullet-proof plate holder 3 that is attached to the back supporting element 110.

According to one embodiment, there is a fit in structure between a component that is attached to back support element 110 and the back load 2, in a manner that allows proper loading of the back load 2 on the back supporting element 110. Thus, for example, there is a fit in structure between the bullet-proof plate holder 3 that is attached to the back support element 110 and the back pack 2 that is attached over the bullet-proof plate holder 3. Similarly, for example, there is a fit in structure between the water container 4 that is attached to the back support element 110, or over the bullet-proof plate holder 3, and the back load 2.

According to one embodiment, the back supporting element 110 is configured to harness at least one back load 2. Examples of a back load 2 include, but not limited to, a back pack, a back parachute pack, a first aid back pack, an assault back pack, a radio communication device, and the like, and any combination thereof.

According to one embodiment, the backload supporting element 110 is configured to harness two back loads 2 attached one on top of the other. For example, a back pack is attached to the back supporting element 110, and a smaller day pack is attached to the back pack. When the back pack is released from the back supporting element 110 of the harness 1, a user may release the day pack from the bag pack and attach it to the back supporting element 110 instead of the back pack. An advantage of this embodiment is that for example in a situation of engaging a combat, a user may rapidly release the back pack from the back supporting element 110 and then rapidly release the day pack from the back pack, and rapidly attach the day pack to the back support element 110, without wasting time in for example opening the back pack and choosing gear that is needed to the combat. Another advantage of this embodiment is that since there is no need to open the back pack and remove items from the back pack, the outfit of the back pack is not disturbed, thus allowing proper handling at a later stage.

Turning now to FIGS. 1 and 2, according to one embodiment, the first shoulder strap 120 and the second shoulder strap 130 are attached to an upper part of the back supporting element 110, in a manner that allows strapping the first shoulder strap 120 and the second shoulder strap 130 over the corresponding shoulders of a user.

According to some embodiments, the first shoulder strap 120 and the second shoulder strap 130 are configured to attach to the waist strap 140, as illustrated in FIGS. 1 and 2. According to one embodiment, the attachment of the first shoulder strap 120 and the second shoulder strap 130 to the waist strap 140 is permanent, for example, but not limited to, by stitching or screwing. According to a preferred embodiment, the attachment of the first shoulder strap 120 and the second shoulder strap 130 to the waist strap 140 is temporary, for example but not limited to, by using at least one buckle.

According to one embodiment, as a person skilled in the art may recognize, the first shoulder strap 120 and the second shoulder strap 130 comprise buckles that allow fastening of the first shoulder strap 120 and the second shoulder strap 130 by pulling the straps downwards. According to a preferred embodiment, the first shoulder strap 120 and the second shoulder strap 130 comprise buckles that allow fastening of the first shoulder strap 120 and the second shoulder strap 130 by pulling the straps upwards. According to another embodiment, the first shoulder strap 120 and the second shoulder strap 130 comprise buckles of any type known in the art, preferably cam lock buckles.

Figure 5:
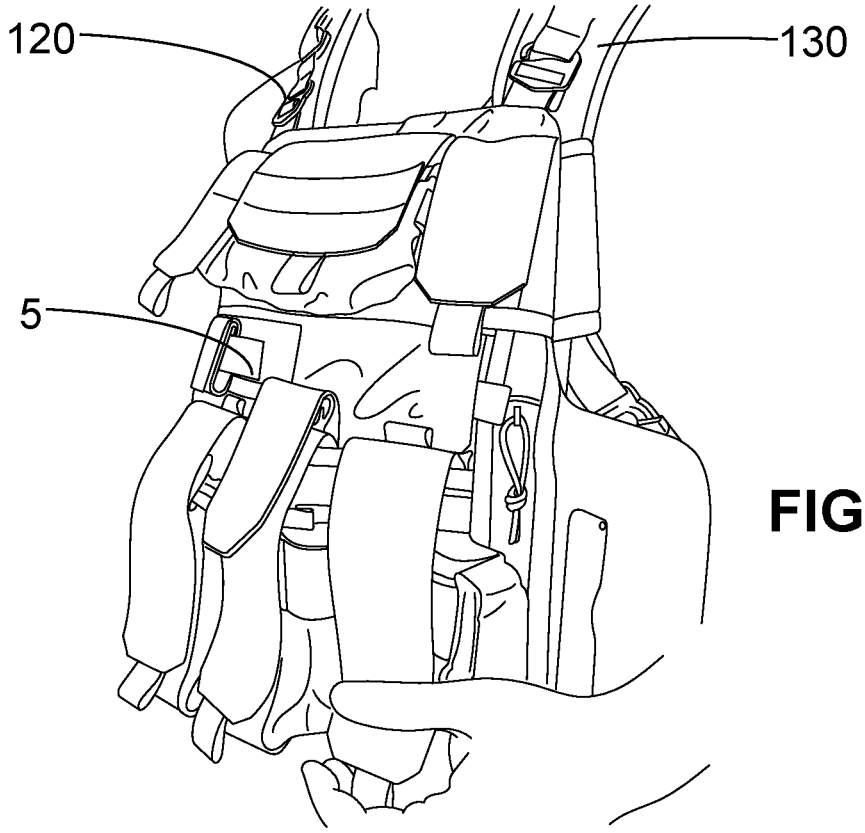
FIG. 5 schematically illustrates, according to an exemplary embodiment, a perspective view of a harness bearing a front load.

FIG. 5 schematically illustrates, according to an exemplary embodiment, a perspective view of a harness 1 bearing a front load 5. According to this embodiment, the first shoulder strap 120 and the second shoulder strap 130 are configured to bear the front load 5. According to this embodiment, a front load 5 is attached to the first shoulder strap 120 and the second shoulder strap 130 in a manner that harnesses the front load 5 on the frontal side of a user, for example over the chest and/or the abdomen. Examples of a front load 5 include, but not limited to, a bullet-proof vest, an ammunition vest, a front bag, a front parachute pack, and the like, and any combination thereof.

Figure 6:
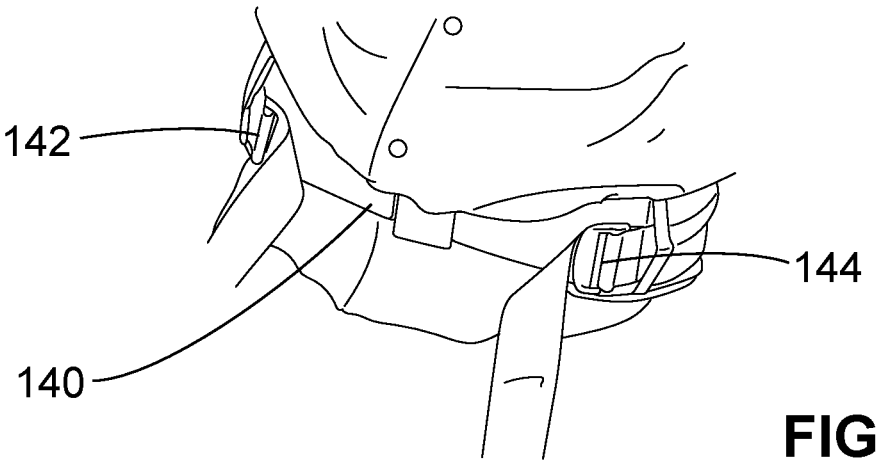
FIG. 6 schematically illustrates, according to an exemplary embodiment, a front view of a harness, when the waist strap of the harness comprises a first buckle and a second buckle at the sides of the waist strap.

FIG. 6 schematically illustrates, according to an exemplary embodiment, a front view of a harness 1, when the waist strap 140 of the harness 1 comprises a first buckle 142 and a second buckle 144 at the sides of the waist strap 140. According to one embodiment, the waist strap 140 comprises a first buckle 142 at the right side of the waist strap 140 and a second buckle 144 at the left side of the waist strap 140. This embodiment is advantageous over an embodiment where a buckle is positioned at the front side of the waste strap 140. A buckle at the front side of the waist strap 140 may exert pressure on the abdomen of a user, whereas a first buckle 142 at the right side and a second buckle 144 at the left side of the waist strap prevent this discomfort.

According to one embodiment, the harness 1 comprises a bridging device for securing the back load 2 to the harness 1, as described in U.S. Pat. No. 6,402,456, the entire contents of which is incorporated herein by reference.

According to one embodiment, the lower back load fixing element 160 is a connector, as described in Israel Patent Application No. IL247012, the entire contents of which is incorporated herein by reference.

According to another aspect of the present subject matter there is provided a method of fast harnessing and instantaneously releasing a back load on and off a user, the method comprising:

- loading a harness on a torso of the user using shoulder straps and a waist strap that are provided to the harness, wherein said harness comprises at least one upper back load fixing element and at least one lower back load fixing element;
- placing a back load having at least one upper anchoring element that corresponds to be engaged with the at least one upper back load fixing element and at least one lower anchoring element that corresponds to be engaged with the at least one lower back load fixing element;
- instantaneously releasing the back load off the harness using a releasing mechanism.

Due to its features—described above, the harness 1 of the present subject matter provides an easy and convenient way for a user to carry a front load and a back load in a manner that does not generate a weight burden on the shoulders of the users, but rather transfers most of the weight burden to the waist of the user.

It is appreciated that certain features of the subject matter, which are, for clarity, described in the context of separate embodiments, may also be provided in combination in a single embodiment. Conversely, various features of the subject matter, which are, for brevity, described in the context of a single embodiment, may also be provided separately or in any suitable sub combination.

Although the subject matter has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A harness system comprising:

a harness comprising:

a back supporting element;

a first shoulder strap and a second shoulder strap;

a waist strap;

at least one upper back load fixing element, and at least one lower back load fixing element, wherein the at least one upper back load fixing element and the at least one lower back load fixing element are configured to fix the back load, a back load configured to be harnessed to the harness, the back load comprising:

a body configured to contain gear to be carried;

at least one upper anchoring element configured to correspondingly engage with the at least one upper back load fixing element; and at least one lower anchoring element configured to correspondingly engage with the at least one lower back load fixing element, wherein the back supporting element comprises a sliding element positioned above the at least one upper back load fixing element, thus allowing sliding of the at least one upper anchoring element towards the at least one upper back load fixing element when the back load is loaded on the back supporting element.

2. The harness of claim 1, wherein the at least one upper back load fixing element, the at least one lower back load fixing element, or the at least one upper back load fixing element and the at least one lower back load fixing element are lockable.

3. The harness of claim 1, wherein the at least one upper back load fixing element is attached to an upper part of the back supporting element, and the at least one lower back load fixing element is attached to the waist strap.

4. The harness of claim 3, wherein a distance between the at least one upper back load fixing element and the at least one lower back load fixing element is fixed.

5. The harness of claim 3, wherein a distance between the at least one upper back load fixing element and the at least one lower back load fixing element is changeable.

6. The harness of claim 1, wherein the at least one upper back load fixing element is attached to an upper part of the back supporting element, and the at least one lower back load fixing element is attached to a lower part of the back support element.

7. The harness of claim 1, further comprising a release mechanism for releasing the back load from the back supporting element.

8. The harness of claim 1, wherein there is a fit in structure between the back supporting element and the back load, in a manner that allows proper loading of the back load on the back supporting element.

9. The harness of claim 1, wherein a bullet-proof plate holder is attached to the back supporting element.

10. The harness of claim 1, wherein a water container is attached to the back supporting element.

11. The harness of claim 1, wherein the first shoulder strap and the second shoulder strap are configured to bear a front load.

12. The harness of claim 1, wherein the waist strap comprises a first buckle at the right side of the waist strap and a second buckle at the left side of the waist strap.

13. A method of fast harnessing and instantaneously releasing a back load on and off a user, the method comprising:

loading a harness of the harness system according to claim 1 on a torso of the user using the shoulder straps and the waist strap;

placing a back load of the harness system, while engaging the at least one upper anchoring element with the at least one upper back load fixing element, and engaging the at least one lower anchoring element with the at least one lower back load fixing element, and instantaneously releasing the back load off the harness using a releasing mechanism.

14. The method of fast harnessing and instantaneously releasing a back load according to claim 13, wherein the releasing mechanism is configured to simultaneously disengage the at least one upper anchoring element from the at least one upper back load fixing element and the at least one lower anchoring element from the at least one lower back load fixing element.

* * * * *